US006490741B1

(12) United States Patent
Wheeler

(10) Patent No.: US 6,490,741 B1
(45) Date of Patent: Dec. 10, 2002

(54) BED COVERING SYSTEM

(76) Inventor: Peggy A. Wheeler, 102 Perry La., Harrisburg, SD (US) 57032

( * ) Notice: Subject to any disclaimer, the term of this patent is extended or adjusted under 35 U.S.C. 154(b) by 0 days.

(21) Appl. No.: 10/016,715

(22) Filed: Oct. 22, 2001

(51) Int. Cl.[7] ..... A47G 9/04
(52) U.S. Cl. ..... 5/494; 5/498; 5/502
(58) Field of Search ..... 5/494, 496, 498, 5/502

(56) References Cited

U.S. PATENT DOCUMENTS

| | | | | | |
|---|---|---|---|---|---|
| 3,530,487 | A | * | 9/1970 | Beer | 5/494 |
| 3,857,124 | A | | 12/1974 | Hadley | 5/334 |
| 4,161,044 | A | | 7/1979 | Bogle | 5/494 |
| 4,241,466 | A | * | 12/1980 | Mendyk | 5/494 |
| 5,208,927 | A | | 5/1993 | Lachmar | 5/497 |
| 5,566,411 | A | | 10/1996 | Eiler | 5/494 |
| 5,666,680 | A | | 9/1997 | Hackett | 5/692 |
| 5,732,424 | A | * | 3/1998 | Bond | 5/498 |
| 6,088,852 | A | | 7/2000 | Quandt | 5/482 |
| 6,098,219 | A | * | 8/2000 | Milber | 5/494 |

* cited by examiner

*Primary Examiner*—Michael F. Trettel

(57) ABSTRACT

A bed covering system for assisting in the making of a bed and for securing the bedding upon a bed. The bed covering system includes a lower cover having an upper portion and a side wall positionable about a mattress, an upper cover having an upper surface and a lower surface, and a zipper having a lower track attached to the lower cover and an upper track attached to the upper cover for selectively securing the upper cover to the lower cover. The zipper is preferably comprised of a structure that allows opposing ends of the zipper to be partially removed depending upon the end of the mattress the individual sleeps upon. The zipper is attached to a longitudinal side of the upper cover and the lower cover which is preferably adjacent an obstruction such as a wall. A middle cover is preferably permanently attached to the lower cover positioned beneath the upper cover.

20 Claims, 5 Drawing Sheets

BED COVERING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to bedding and more specifically it relates to a bed covering system for assisting in the making of a bed and for securing the bedding upon a bed.

2. Description of the Prior Art

Bed covering has been in use for years. Typically, bed covering is comprised of a sheet with covering loosely positioned over the sheet. The sheet and covering are positioned upon the mattress with the end portion thereof typically tucked in beneath the mattress.

The main problem with conventional bed covering is that they are difficult to utilize in making a bed, particularly beds that are elevated such as a bunk bed or a loft bed. Another problem with conventional bed covering is that they often times become undesirably removed from about the mattress.

Examples of patented devices which are related to the present invention include U.S. Pat. No. 5,666,680 to Hackett; U.S. Pat. No. 6,088,852 to Quandt; U.S. Pat. No. 4,161,044 to Bogle; U.S. Pat. No. 5,566,411 to Eiler; U.S. Pat. No. 3,857,124 to Hadley; and U.S. Pat. No. 5,208,927 to Lachmar.

While these devices may be suitable for the particular purpose to which they address, they are not as suitable for assisting in the making of a bed and for securing the bedding upon a bed. Conventional bed covering is not suitable for usage upon elevated mattresses or where it is desirable to maintain the bed covering properly positioned upon a mattress.

In these respects, the bed covering system according to the present invention substantially departs from the conventional concepts and designs of the prior art, and in so doing provides an apparatus primarily developed for the purpose of assisting in the making of a bed and for securing the bedding upon a bed.

SUMMARY OF THE INVENTION

In view of the foregoing disadvantages inherent in the known types of bed covering now present in the prior art, the present invention provides a new bed covering system construction wherein the same can be utilized for assisting in the making of a bed and for securing the bedding upon a bed.

The general purpose of the present invention, which will be described subsequently in greater detail, is to provide a new bed covering system that has many of the advantages of the bed covering mentioned heretofore and many novel features that result in a new bed covering system which is not anticipated, rendered obvious, suggested, or even implied by any of the prior art bed covering, either alone or in any combination thereof.

To attain this, the present invention generally comprises a lower cover having an upper portion and a side wall positionable about a mattress, an upper cover having an upper surface and a lower surface, and a zipper having a lower track attached to the lower cover and an upper track attached to the upper cover for selectively securing the upper cover to the lower cover. The zipper is preferably comprised of a structure that allows opposing ends of the zipper to be partially removed depending upon the end of the mattress the individual sleeps upon. The zipper is attached to a longitudinal side of the upper cover and the lower cover which is preferably adjacent an obstruction such as a wall.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a bed covering system that will overcome the shortcomings of the prior art devices.

A second object is to provide a bed covering system for assisting in the making of a bed and for securing the bedding upon a bed.

Another object is to provide a bed covering system that can be utilized upon various sizes and styles of beds.

An additional object is to provide a bed covering system that reduces the amount of time and effort required to make a bed.

A further object is to provide a bed covering system that may be utilized upon elevating beds, camper beds, houseboat beds and other beds that are difficult to make.

Another object is to provide a bed covering system that does not require any portion of the covering to be tucked beneath the mattress.

A further object is to provide a bed covering system that reduces the likelihood of the bed covering from being removed.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
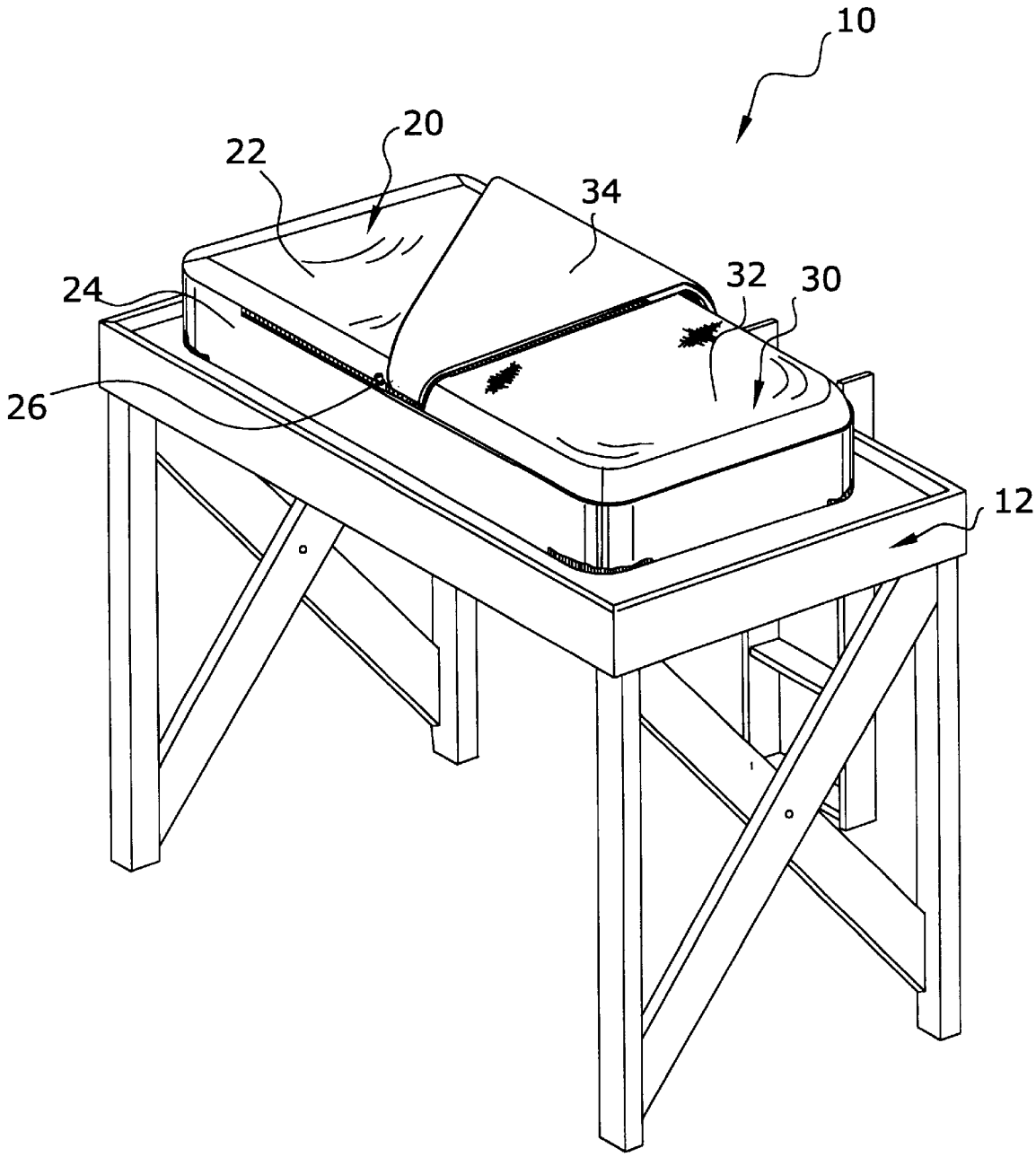
FIG. 1 is an upper perspective view of the present invention positioned about a mattress.

Turning now descriptively to the drawings, in which similar reference characters denote similar elements throughout the several views, FIGS. 1 through 5 illustrate a bed covering system 10, which comprises a lower cover 20 having an upper portion 22 and a side wall 24 positionable about a mattress 14, an upper cover 30 having an upper surface 32 and a lower surface 34, and a zipper having a lower track 26 attached to the lower cover 20 and an upper track 36 attached to the upper cover 30 for selectively securing the upper cover 30 to the lower cover 20. The zipper is preferably comprised of a structure that allows opposing ends of the zipper to be partially removed depending upon the end of the mattress 14 the individual sleeps upon. The zipper is attached to a longitudinal side of the upper cover 30 and the lower cover 20 which is preferably adjacent an obstruction such as a wall or difficult to reach side of a support frame 12.

Figure 2:
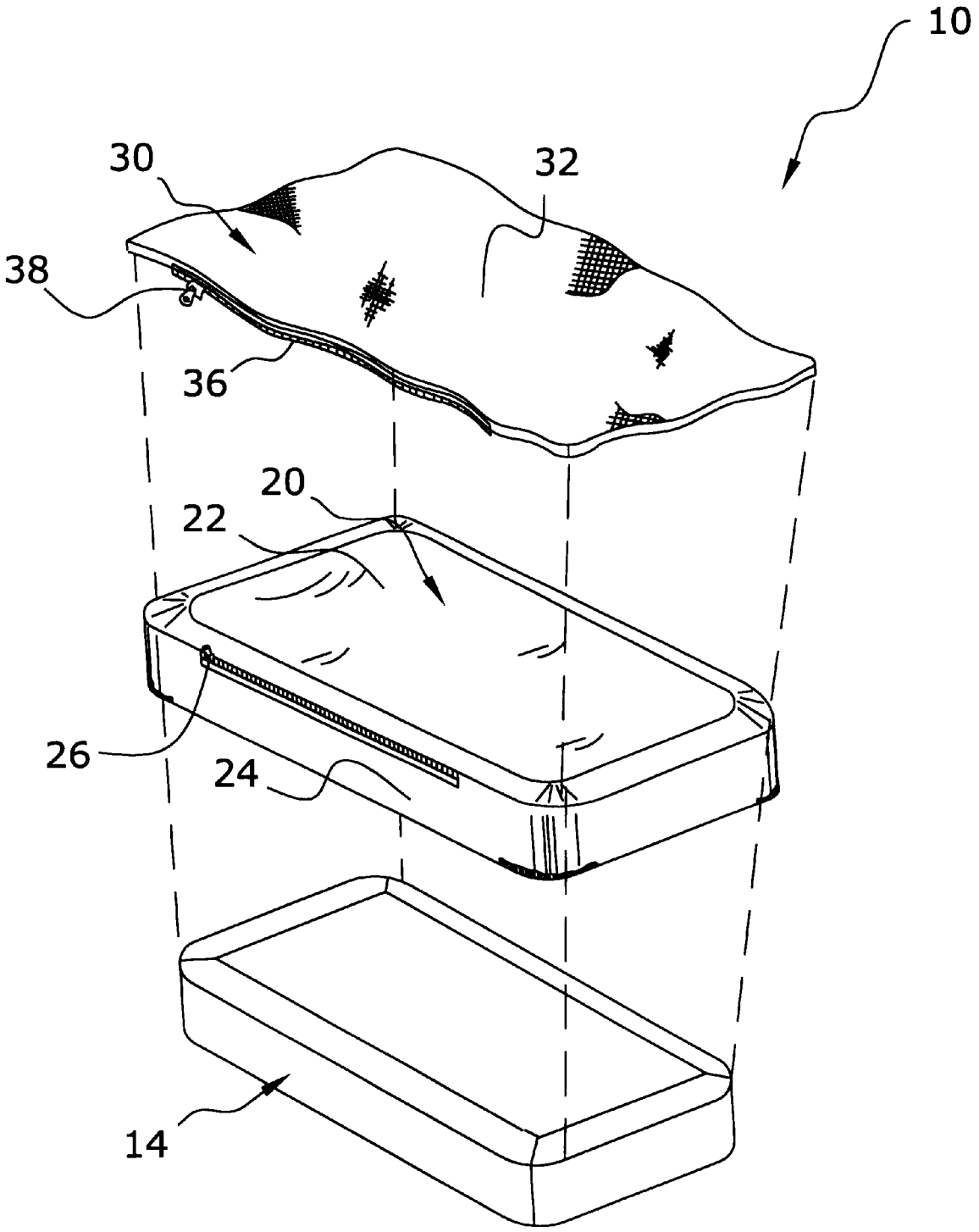
FIG. 2 is an exploded upper perspective view of the present invention with respect to a mattress.
Figure 3:
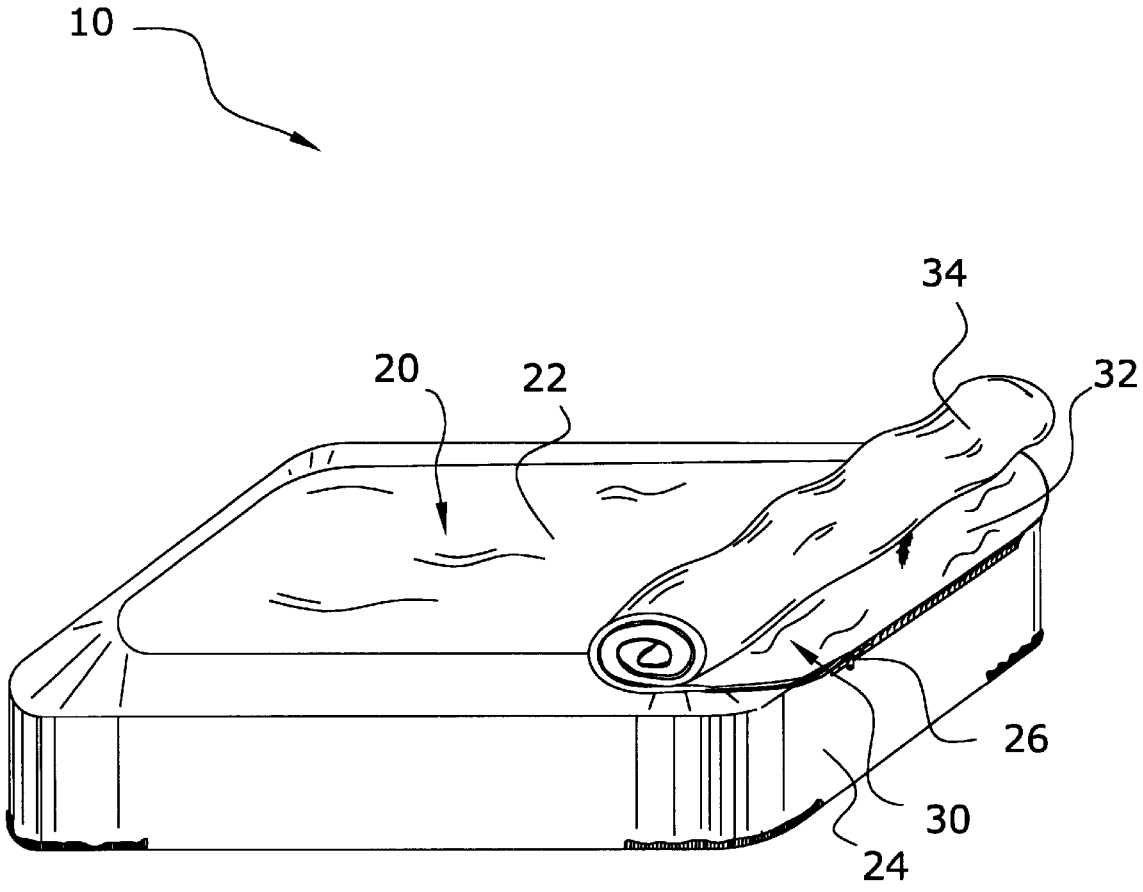
FIG. 3 is an upper perspective view of the present invention positioned about a mattress.
Figure 4:
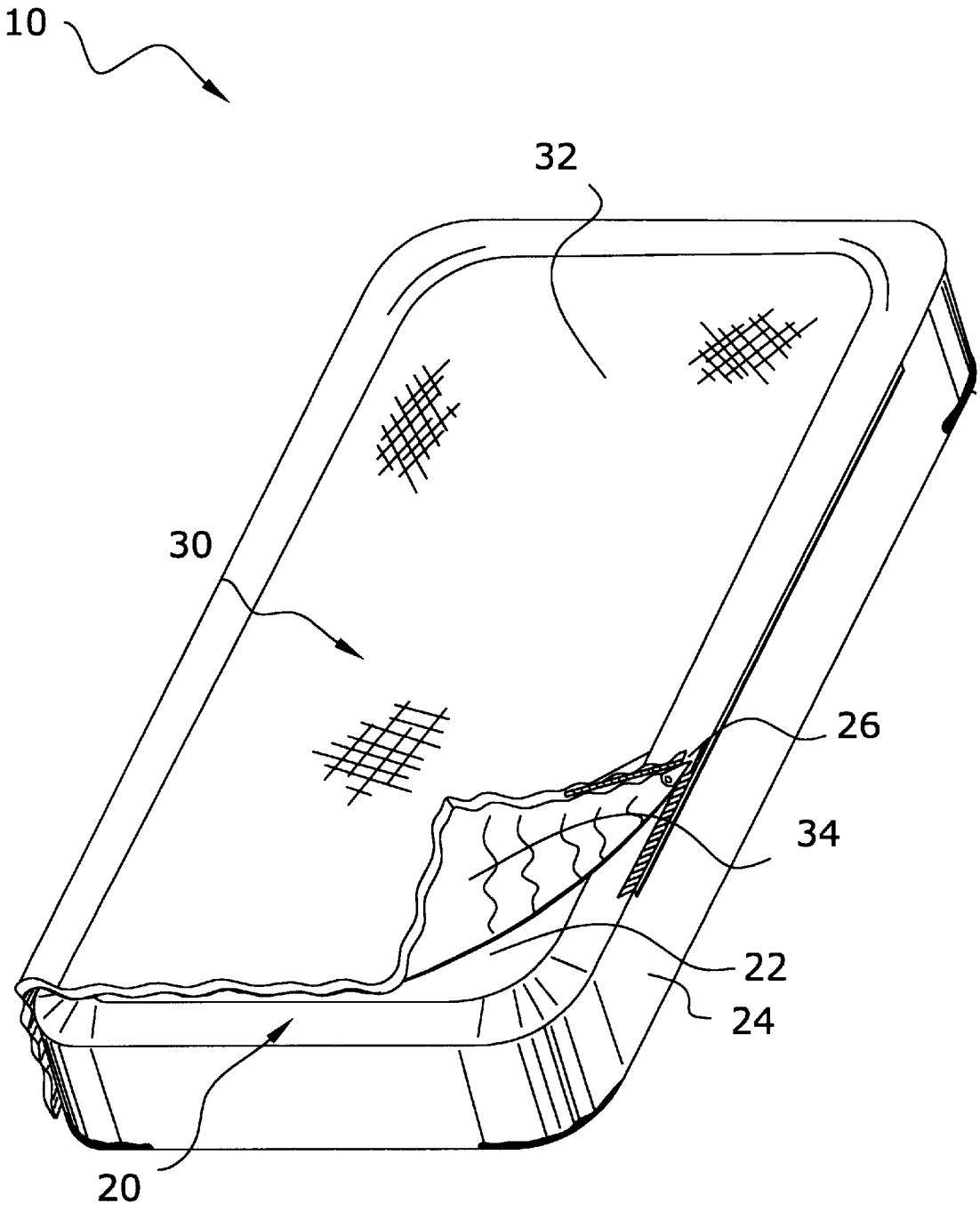
FIG. 4 is an upper perspective view of the present invention positioned about the mattress illustrating the zipper partially opened.

As shown in FIG. 2 of the drawings, the lower cover 20 is formed to snugly fit about the mattress 14. The lower cover 20 preferably has an upper portion 22 and a side wall 24 extending downwardly from the perimeter of the upper portion 22. The side wall 24 has a sufficient height to extend downwardly and beneath a lower portion of the mattress 14 as shown in FIGS. 1, 3 and 4 of the drawings. The lower perimeter of the lower cover 20 preferably is comprised of an elastic material for assisting in keeping the lower cover 20 properly positioned about the mattress 14. The lower perimeter of the lower cover 20 may have an elastic portion only at the corner portions thereof or along the entire lower perimeter. Various other attachment devices may be utilized within the lower cover 20 for securing about the mattress 14.

The lower cover 20 is preferably rectangular shaped as shown in FIG. 2 of the drawings. Various other shapes may be utilized to construct the lower cover 20 depending upon the shape and size of the mattress 14. The lower cover 20 may be constructed of various types of materials which are well-known in the linen industry but should not be limited solely to linen type materials.

As shown in FIGS. 1 through 4 of the drawings, an upper cover 30 is removably connected to the lower cover 20 by a zipper. The zipper is comprised of a lower track 26 attached to an upper edge of the lower cover 20 and an upper track 36 attached to the edge of the upper cover 30 corresponding to the lower track 26. The lower track 26 is preferably attached to an upper edge of the lower cover 20 between the upper portion 22 and the side wall 24 for providing easy access thereto. As shown in FIG. 2 of the drawings, the zipper preferably does not extend the entire length of the lower cover 20 and the upper cover 30.

The lower track 26 and upper track 36 are secured and opened by at least one slide member 38. When the zipper is properly closed, the upper cover 30 is properly secured to the lower cover 20. When the zipper is opened, the upper cover 30 is able to be removed from the lower cover 20. The user may also partially open one end of the zipper to reduce tension within the upper cover 30 at the end they are sleeping at. As shown in FIGS. 1 through 4 of the drawings, the zipper is attached to a longitudinal edge of the covers 20, 30 that is positioned adjacent a wall or other obstructing making it difficult to make the bed.

The upper cover 30 is preferably rectangular shaped as shown in FIG. 2 of the drawings. Various other shapes may be utilized to construct the upper cover 30 depending upon the shape and size of the mattress 14. The upper cover 30 may be constructed of various types of materials which are well-known in the linen industry but should not be limited solely to linen type materials. The upper cover 30 is preferably constructed of a material having a greater insulation value than the lower cover 20. The upper cover 30 and the lower cover 20 may be comprised of one or more layers of linen as can be appreciated.

The longitudinal edge of the upper cover 30 opposite of the upper track 36 is preferably sufficient in length to extend downwardly past the side of the mattress 14 as shown in FIG. 4 of the drawings. The distal end of the upper cover 30 opposite of where the individual sleeps is preferably sufficient in length to extend downwardly past the side of the mattress 14.

Figure 5:
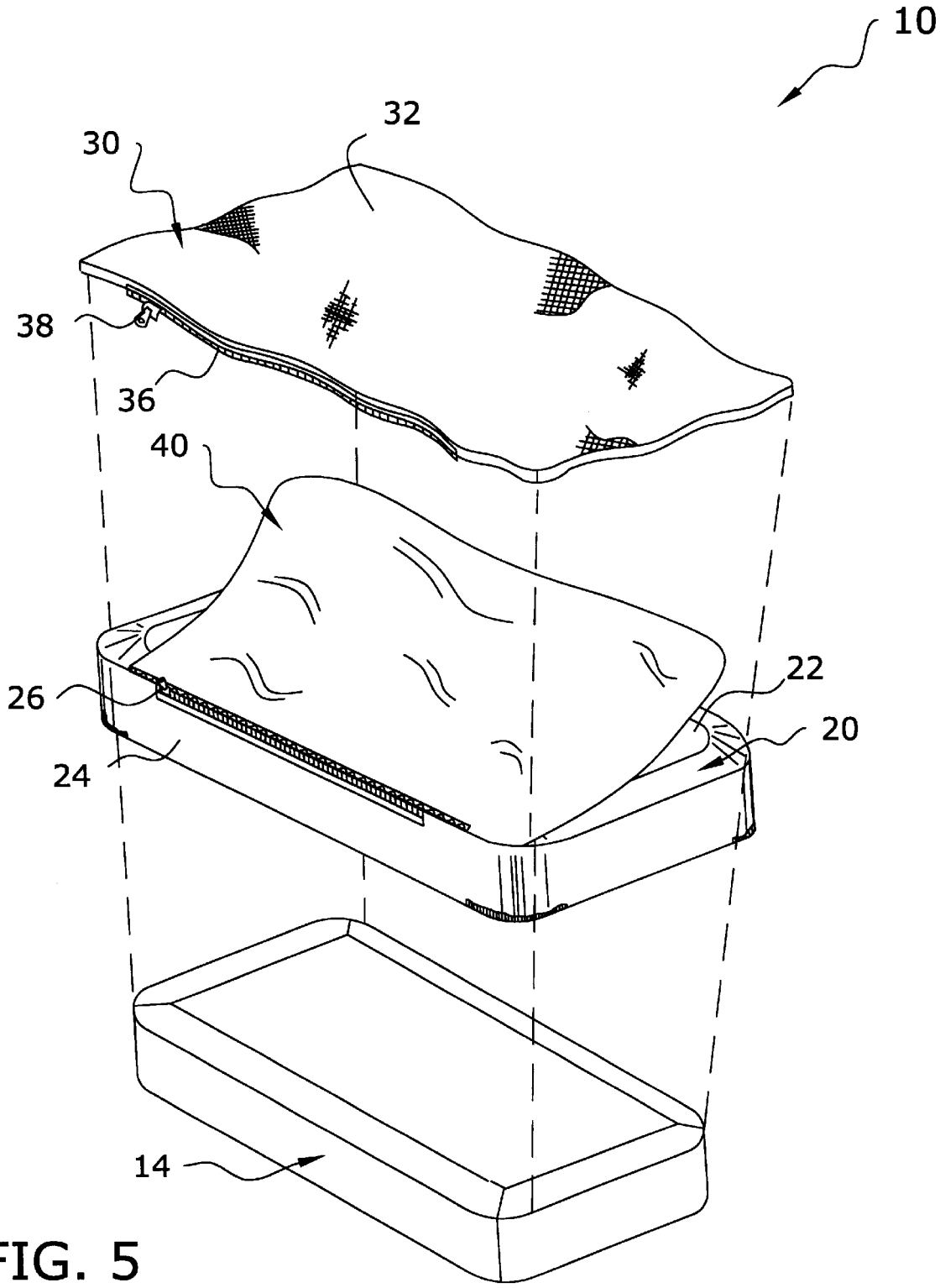
FIG. 5 is an exploded upper perspective view of the present invention with respect to a mattress containing a middle cover permanently attached to the lower cover.

As shown in FIG. 5 of the drawings, a middle cover 40 may be permanently and nonmovably secured to the lower cover 20 adjacent to the lower track 26 by a conventional fastening means such as but not limited to sewing. The middle cover 40 extends over the lower cover 20 similar to the upper cover 30. The middle cover 40 is preferably comprised of a material having a lower insulation value than the upper cover 30. The middle cover 40 is preferably secured to the lower cover 20 along a longitudinal side only, however the lower end of the middle cover 40 may also be secured to the lower cover 20 at the lower end thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed covering system, comprising:

a lower cover having an upper portion and a side wall, wherein said lower cover is formed to snugly fit about a mattress;

a middle cover permanently attached to a first longitudinal side of said lower cover;

an upper cover having an upper surface and a lower surface;

a zipper having a lower track, an upper track and at least one slide member slidably extending between said tracks;

wherein said lower track is attached to said first longitudinal side of said lower cover; and wherein said upper track is attached to a first longitudinal side of said upper cover corresponding to said lower track of said lower cover.

2. The bed covering system of claim 1, wherein said upper cover has a second longitudinal side that is sufficient in length to extend about a side of a mattress.

3. The bed covering system of claim 2, wherein said upper cover has a lower end that is sufficient in length to extend about a lower end of a mattress.

4. The bed covering system of claim 1, wherein said upper cover has a higher insulation value than said lower cover.

5. The bed covering system of claim 1, wherein said lower cover has a lower perimeter extending about said side wall, wherein said lower perimeter is comprised of an elastic material.

6. The bed covering system of claim 5, wherein said elastic material is only positioned about four corner portions of said lower perimeter.

7. The bed covering system of claim 1, wherein said zipper allows both ends thereof to be partially opened with the opposing end thereof to remain closed.

8. The bed covering system of claim 7, wherein said zipper includes two slide members.

9. The bed covering system of claim 1, wherein said upper cover is comprised of a rectangular shape.

10. The bed covering system of claim 9, wherein said lower cover is comprised of a rectangular shape.

11. A bed covering system, comprising:

a lower cover having an upper portion and a side wall, wherein said lower cover is formed to snugly fit about a mattress;

a middle cover attached to a first longitudinal side of said lower cover;

an upper cover having an upper surface and a lower surface;

a zipper having a lower track, an upper track and at least one slide member slidably extending between said tracks;

wherein said lower track is attached to said first longitudinal side of said lower cover; and wherein said upper track is attached to a first longitudinal side of said upper cover corresponding to said lower track of said lower cover.

12. The bed covering system of claim 11, wherein said upper cover has a second longitudinal side that is sufficient in length to extend about a side of a mattress.

13. The bed covering system of claim 12, wherein said upper cover has a lower end that is sufficient in length to extend about a lower end of a mattress.

14. The bed covering system of claim 11, wherein said upper cover has a higher insulation value than said lower cover.

15. The bed covering system of claim 11, wherein said lower cover has a lower perimeter extending about said side wall, wherein said lower perimeter is comprised of an elastic material.

16. The bed covering system of claim 15, wherein said elastic material is only positioned about four comer portions of said lower perimeter.

17. The bed covering system of claim 11, wherein said zipper allows both ends thereof to be partially opened with the opposing end thereof to remain closed.

18. The bed covering system of claim 17, wherein said zipper includes two slide members.

19. The bed covering system of claim 11, wherein said upper cover is comprised of a rectangular shape.

20. The bed covering system of claim 19, wherein said lower cover is comprised of a rectangular shape.

* * * * *